US007854141B1

(12) United States Patent
Breen

(10) Patent No.: US 7,854,141 B1
(45) Date of Patent: Dec. 21, 2010

(54) ENERGY CONSERVATION IN A SELF-CONTAINED AIR-CONDITIONING UNIT

(76) Inventor: Joseph G. Breen, 575 Echo Glen Ave., River Vale, NJ (US) 07675

( * ) Notice: Subject to any disclaimer, the term of this patent is extended or adjusted under 35 U.S.C. 154(b) by 177 days.

(21) Appl. No.: 12/330,053

(22) Filed: Dec. 8, 2008

(51) Int. Cl.
*F25D 21/00* (2006.01)

(52) U.S. Cl. ..... 62/272; 62/81; 62/506

(58) Field of Classification Search ..... 62/81, 62/272, 277, 279, 506
See application file for complete search history.

(56) References Cited

U.S. PATENT DOCUMENTS

| | | | | |
|---|---|---|---|---|
| 2,461,636 | A * | 2/1949 | Gaylor | 62/81 |
| 3,837,175 | A * | 9/1974 | Miller | 62/192 |
| 4,280,334 | A | 7/1981 | Lakdawala | |
| 4,380,910 | A | 4/1983 | Hood et al. | |
| 4,493,195 | A | 1/1985 | Zalesak et al. | |
| 4,910,972 | A | 3/1990 | Jaster | |
| 4,934,451 | A | 6/1990 | Colvin | |
| 4,977,753 | A | 12/1990 | Maisotsenko et al. | |
| 5,113,668 | A | 5/1992 | Wachs, III et al. | |
| 5,269,151 | A * | 12/1993 | Dinh | 62/81 |
| 5,345,778 | A | 9/1994 | Roberts | |
| 5,357,764 | A | 10/1994 | Dickman | |
| 6,070,423 | A | 6/2000 | Hebert | |
| 6,684,648 | B2 * | 2/2004 | Faqih | 62/93 |
| 6,854,277 | B2 * | 2/2005 | Gist et al. | 62/81 |
| 6,857,285 | B2 | 2/2005 | Hebert | |
| 7,111,472 | B1 * | 9/2006 | Cloud | 62/278 |
| 2004/0144118 | A1 | 7/2004 | Hebert | |
| 2005/0028545 | A1 | 2/2005 | Hebert | |

* cited by examiner

*Primary Examiner*—Melvin Jones
(74) *Attorney, Agent, or Firm*—Arthur Jacob

(57) ABSTRACT

A self-contained air-conditioning unit is modified to effect conservation of energy during operation of the unit. Refrigerant is moved along a refrigerant circuit for circulation through a compressor, a condenser and an evaporator within a housing which includes a base. The evaporator is raised above the base a distance sufficient to enable collection of condensate from the evaporator and transfer of the collected condensate by gravity to a condensate reservoir tray located adjacent the base. A heat exchange conduit is inserted into the refrigerant circuit, between the compressor and the condenser, and is placed in the condensate reservoir tray so as to be immersed in the condensate transferred to the condensate reservoir tray for enabling transfer of heat from the heat exchange conduit to condensate in the condensate reservoir tray during operation of the air-conditioning unit, thereby reducing the amount of energy needed to operate the unit.

15 Claims, 3 Drawing Sheets

ENERGY CONSERVATION IN A SELF-CONTAINED AIR-CONDITIONING UNIT

The present invention relates generally to self-contained air-conditioning units and pertains, more specifically, to modifying self-contained air-conditioning units to effect conservation of energy during operation of such units.

Self-contained air-conditioning units currently are in widespread use in providing cooled air to building interiors. These air-conditioning units circulate a refrigerant through a refrigerant circuit which includes a compressor, a condenser and an evaporator, all placed within a common housing, rendering the units self-contained. A prevalent type of self-contained air-conditioning unit is the type installed on the roof of a building for supplying cooled air, through appropriate ducts, to the interior of the building. The housing of such a unit usually rests upon a platform, or "curb rails", on the building roof and is accessible readily for maintenance and repair during the term of service, as well as for completing installation of a unit when the unit initially is placed into service.

A characteristic of these self-contained air-conditioning units is the generation of condensate at external surfaces of the evaporator of the unit during operation of the unit. Usually, this condensate is channeled away from the evaporator and is discarded. The present invention utilizes the condensate generated during operation of a self-contained air-conditioning unit to effect conservation of the energy needed to operate the unit. As such, the present invention attains several objects and advantages, some of which are summarized as follows: Provides a method for modifying an existing self-contained air-conditioning unit to effect conservation of energy needed to operate the unit; enables a simplified and inexpensive modification of an installed self-contained air-conditioning unit so that condensate generated during operation of the unit, rather than merely being discarded, is utilized for attaining energy conservation; increases economy of operation of an existing installed self-contained air-conditioning unit; increases the efficiency of operation of a self-contained air-conditioning unit; increases the longevity of a self-contained air-conditioning unit to provide the unit with an extended service life.

The above objects and advantages, as well as further objects and advantages, are attained by the present invention, which may be described briefly as a method for modifying a self-contained air-conditioning unit to effect conservation of energy during operation of the unit, the unit having a housing including an exterior and an interior within which refrigerant is circulated through a refrigerant circuit including a compressor, a condenser and an evaporator, the housing having a basal surface adjacent a basal level, and the evaporator having a lowermost edge and placed within the housing with the lowermost edge closely adjacent the basal surface of the housing, the method comprising: elevating the lowermost edge of the evaporator to an elevated level spaced vertically above the basal level, and securing the evaporator in place within the housing with the lowermost edge at the elevated level; placing a condensate collection pan in a position beneath the lowermost edge of the evaporator for collecting condensate emanating from the evaporator during operation of the unit, at a selected level spaced vertically above the basal level by a vertical distance from the basal level; inserting a heat exchange conduit into the refrigerant circuit between the compressor and the condenser; placing a condensate reservoir tray adjacent the basal level; placing the heat exchange conduit within the condensate reservoir tray, in position to become immersed in condensate within the condensate reservoir tray; providing a condensate passage between the condensate collection pan and the condensate reservoir tray for the transfer of condensate from the condensate collection pan to the condensate reservoir tray; and selecting the vertical distance between the selected level and the basal level to assure effective transfer of condensate from the condensate collection pan to the condensate reservoir tray by gravity such that the heat exchange conduit will be immersed in condensate from the evaporator for the transfer of heat from the heat exchange conduit to condensate in the condensate reservoir tray during operation of the air-conditioning unit.

In addition, the present invention provides an improvement for modifying a self-contained air-conditioning unit to effect conservation of energy during operation of the unit, the unit having a housing including an exterior and an interior within which refrigerant is circulated through a refrigerant circuit including a compressor, a condenser and an evaporator, the housing having a basal surface adjacent a basal level, and the evaporator having a lowermost edge and placed within the housing with the lowermost edge closely adjacent the basal surface of the housing, the improvement comprising: the lowermost edge of the evaporator being elevated to an elevated level spaced vertically above the basal level, and the evaporator being secured in place within the housing with the lowermost edge at the elevated level; a condensate collection pan placed in a position beneath the lowermost edge of the evaporator for collecting condensate emanating from the evaporator during operation of the unit, at a selected level spaced vertically above the basal level by a vertical distance from the basal level; a heat exchange conduit inserted into the refrigerant circuit between the compressor and the condenser; a condensate reservoir tray placed adjacent the basal level; the heat exchange conduit being placed within the condensate reservoir tray, in position to become immersed in condensate within the condensate reservoir tray; a condensate passage between the condensate collection pan and the condensate reservoir tray for the transfer of condensate from the condensate collection pan to the condensate reservoir tray; and the vertical distance between the selected level and the basal level being sufficient to assure effective transfer of condensate from the condensate collection pan to the condensate reservoir tray by gravity such that the heat exchange conduit will be immersed in condensate from the evaporator for the transfer of heat from the heat exchange conduit to condensate in the condensate reservoir tray during operation of the air-conditioning unit.

Further, the present invention includes a method for modifying an existing self-contained air-conditioning unit to effect conservation of energy during operation of the unit, the unit having a housing including an exterior and an interior within which refrigerant is circulated through a refrigerant circuit including a compressor, a condenser and an evaporator, the housing having a basal surface adjacent a basal level, and the evaporator having a lowermost edge and placed within the housing with the lowermost edge closely adjacent the basal surface of the housing, the method comprising: replacing the evaporator with an alternate evaporator having a corresponding lowermost edge; elevating the corresponding lowermost edge of the alternate evaporator to an elevated level spaced vertically above the basal level, and securing the alternate evaporator in place within the housing with the corresponding lowermost edge at the elevated level; placing a condensate collection pan in a position beneath the corresponding lowermost edge of the alternate evaporator for collecting condensate emanating from the alternate evaporator during operation of the unit, at a selected level spaced vertically above the basal level by a vertical distance from the basal level; inserting a heat exchange conduit into the refrigerant circuit between the compressor and the condenser; placing a condensate reservoir tray adjacent the basal level; placing the heat exchange conduit within the condensate reservoir tray, in position to become immersed in condensate within the condensate reservoir tray; providing a condensate passage between the condensate collection pan and the condensate reservoir tray for the transfer of condensate from the condensate collection pan to the condensate reservoir tray; and selecting the vertical distance between the selected level and the basal level to assure effective transfer of condensate from the condensate collection pan to the condensate reservoir tray by gravity such that the heat exchange conduit will be immersed in condensate from the alternate evaporator for the transfer of heat from the heat exchange conduit to condensate in the condensate reservoir tray during operation of the air-conditioning unit.

The invention will be understood more fully, while still further objects and advantages will become apparent, in the following detailed description of preferred embodiments of the invention illustrated in the accompanying drawing, in which.

Figure 1:
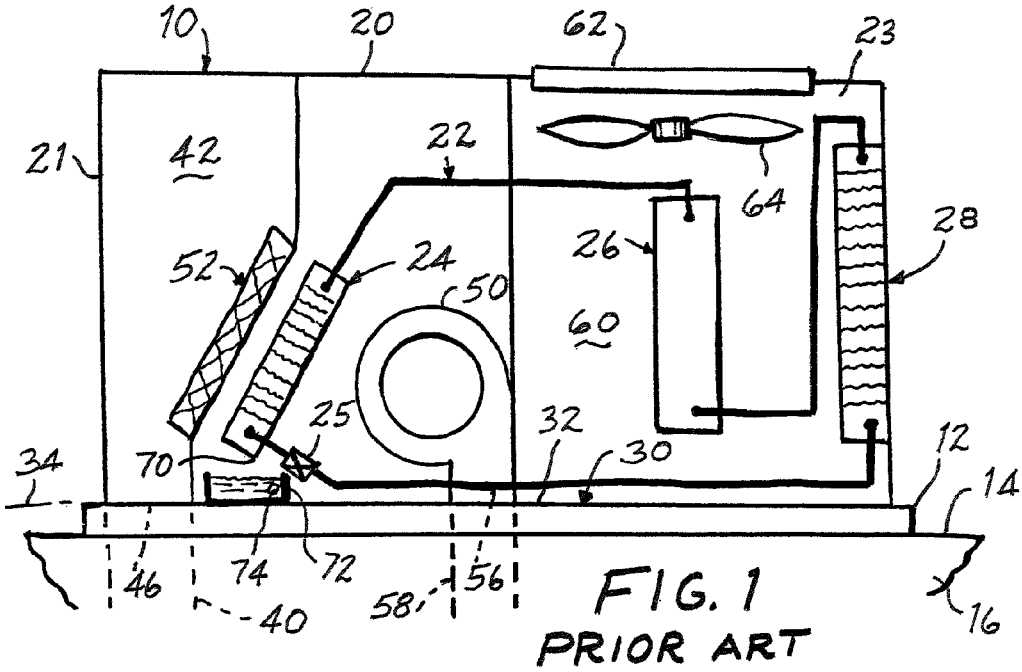
FIG. 1 PRIOR ART
FIG. 1 is a diagrammatic side elevational view of a self-contained air-conditioning unit installed on the roof of a building.

Referring now to the drawing, and especially to FIG. 1 thereof, a self-contained air-conditioning unit is illustrated diagrammatically in the form of unit 10 installed upon curb rails 12 at roof 14 of building 16. Unit 10 includes a housing 20 having an exterior 21 and an interior 23 within which interior 23 is placed a refrigerant circuit 22 including an evaporator 24, a metering device 25, a compressor 26 and a condenser 28. A refrigerant is circulated along refrigerant circuit 22, through metering device 25, evaporator 24, compressor 26 and condenser 28, as is conventional in self-contained air-conditioning units.

Housing 20 has a base 30 providing a basal surface 32 at a basal level 34, and a return air duct 40 in building 16 communicates with a return area 42 within housing 20 through a housing inlet 46 at base 30. A blower 50 draws air from the return area 42, through an air filter 52, and then across evaporator 24, where the air is cooled, and the cool air is delivered to the building 16, through an outlet 56 in base 30 to an air delivery duct 58. Ambient air is drawn across condenser 28 into a compartment 60 within housing 20, and then out of housing 20 at discharge opening 62, by a fan 64 to cool the refrigerant circulating in the refrigerant circuit 22, and thereby dissipate heat from the refrigerant being circulated through refrigerant circuit 22, in a manner conventional in self-contained air-conditioning units.

Evaporator 24 has a lowermost edge 70 located closely adjacent the basal surface 32, and a condensate collection pan 72 rests upon base 30, interposed between the lowermost edge 70 of the evaporator 24 and the basal surface 32 for collecting condensate dripped from the evaporator 24 during operation of the unit 10. Condensate collected in the pan 72 then is directed through a drain 74 and is discarded.

Figure 2:
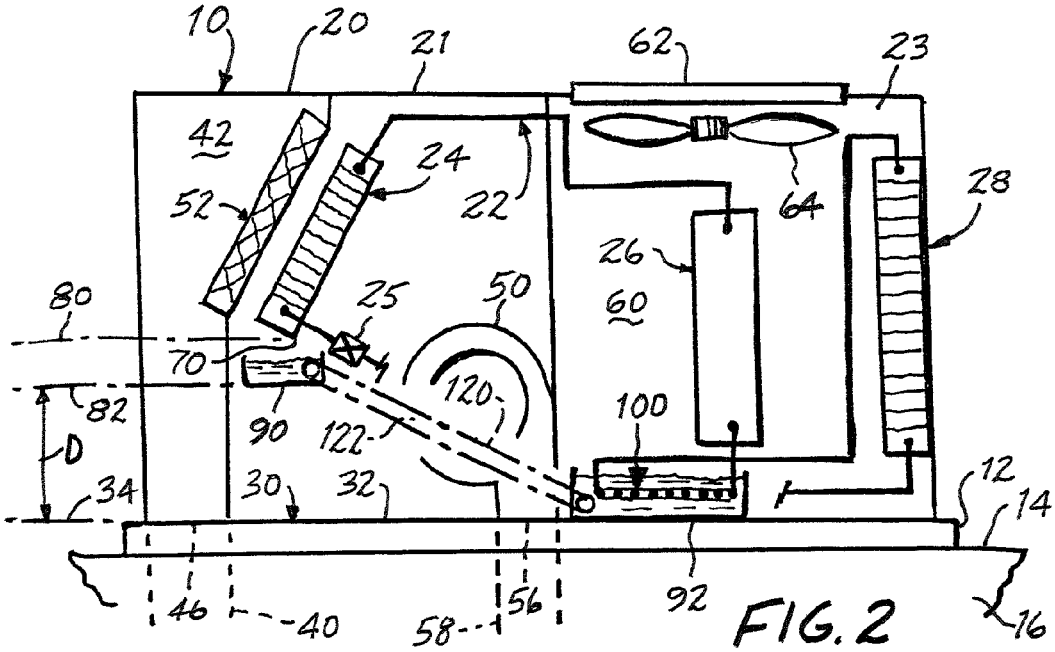
FIG. 2 is a diagrammatic side elevational view of the self-contained air-conditioning unit modified in accordance with the present invention.
Figure 3:
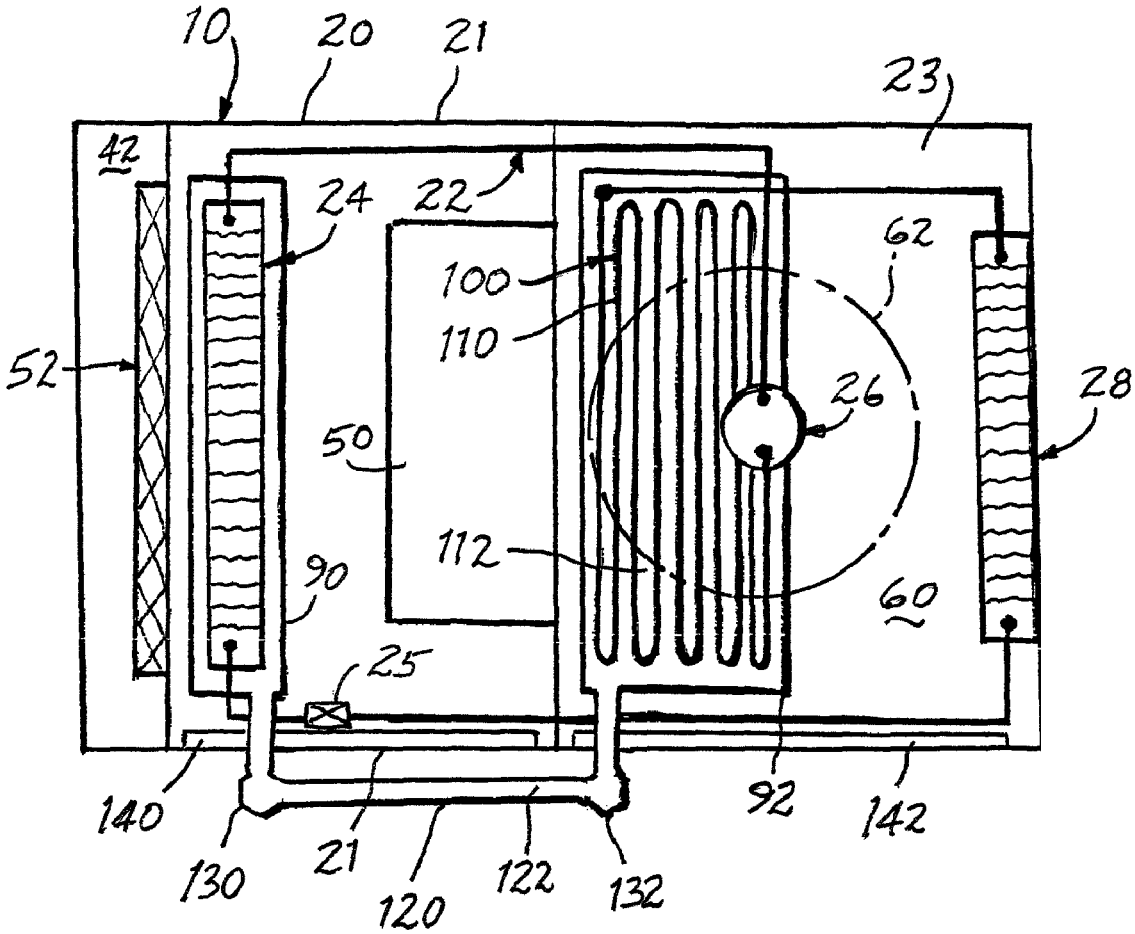
FIG. 3 is a diagrammatic top plan view of the modified self-contained air-conditioning unit of FIG. 2.

Turning now to FIGS. 2 and 3, unit 10 has been modified in accordance with the method of the present invention to effect conservation of energy during operation of the unit 10. Thus, lowermost edge 70 of evaporator 24 has been elevated to an elevated level 80 spaced vertically above the basal level 34 to locate the lowermost edge 70 adjacent a selected level 82 located at a vertical distance D from the basal level 34. A condensate collection pan 90 has been placed beneath the lowermost edge 70 of the evaporator 24, at the selected level 82 placed at the vertical distance D above the basal level 34. A condensate reservoir tray 92 has been placed at the basal level 34, preferably adjacent the compressor 26.

A heat exchange conduit 100 has been inserted into the refrigerant circuit 22, between the compressor 26 and the condenser 28, such that refrigerant leaving the compressor 26 will first pass through the heat exchange conduit 100 before entering the condenser 28. In the preferred construction, heat exchange conduit 100 includes a serpentine configuration 110 providing a path of extended length for the refrigerant, within a relatively compact area 112, for fitting the extended length into the condensate reservoir tray 92. Heat exchange conduit 100 is placed within the condensate reservoir tray 92 and a tubular member 120 is interconnected between the condensate collection pan 90 and the condensate reservoir tray 92 to provide a condensate passage 122 for the transfer of condensate from the condensate collection pan 90 to the condensate reservoir tray 92.

The selected level 82, placed at the vertical distance D between the level 82 and the basal level 34, is selected to assure that condensate collected in the condensate collection pan 90 is transferred effectively from the condensate collection pan 90 to the condensate reservoir tray 92 by gravity. The heat exchange conduit 100 then will be immersed in condensate during operation of the unit 10. The condensate is considerably cooler than the refrigerant leaving the compressor 26 and heat will be transferred from the refrigerant, through the heat exchange conduit 100, to the condensate within the condensate reservoir tray 92, thereby reducing the amount of energy needed to operate compressor 26 and realizing a concomitant reduction in the energy required to operate unit 10. At the same time, the temperature of the condensate in the condensate reservoir tray 92 will be raised to effect evaporation of condensate and avoid the necessity for diverting large volumes of condensate for discard. By selecting the level 82, at vertical distance D, to assure that condensate is transferred effectively by gravity from the condensate collection pan 90 to the condensate reservoir tray 92, no added energy is required to effect the transfer. It has been found that a distance D of about two to six inches will assure the effective transfer of condensate from condensate collection pan 90 to condensate reservoir tray 92. Thus, by pre-cooling the refrigerant which emerges from the compressor 26, prior to the refrigerant entering the condenser 28, the energy required to operate unit 10 is reduced and energy conservation is effected, all with only a minor modification readily executed on an existing, installed unit 10, as well as on newly-manufactured units.

As seen in FIG. 3, in the preferred construction tubular member 120 extends between the condensate collection pan 90 and the condensate reservoir tray 92 outside the housing 20, adjacent the exterior 21, and is connected between a first fitting 130 adjacent the condensate collection pan 90 and a second fitting 132 adjacent the condensate reservoir tray 92. Should the condensate passage 122 become constricted over time, or even obstructed, tubular member 120 is accessed readily for removal and cleaning or replacement, thereby facilitating convenient maintenance and repair. Access doors 140 and 142 provide ready access to the interior 23 of housing 20, facilitating the execution of the above modification of unit 10, as well as subsequent maintenance and repair.

Figure 4:
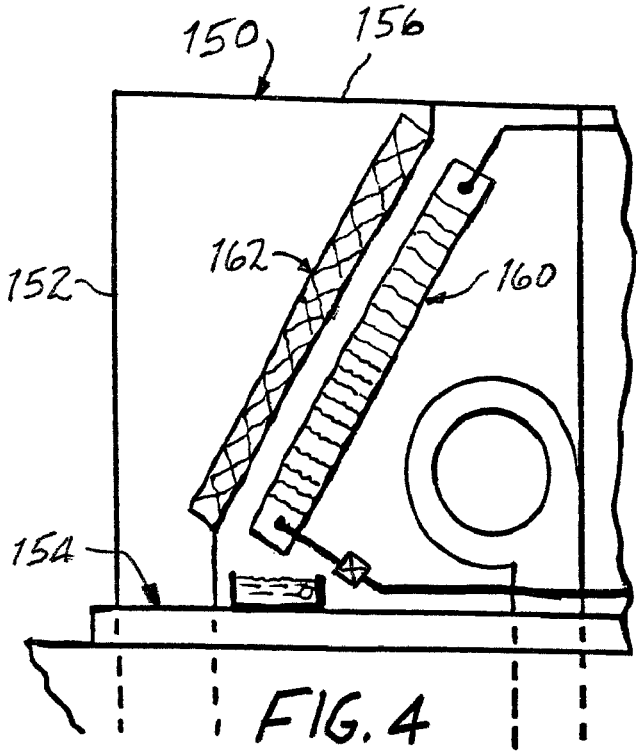
FIG. 4 is a fragmentary diagrammatic side elevational view similar to a portion of FIG. 1 and showing an alternate construction.
Figure 5:
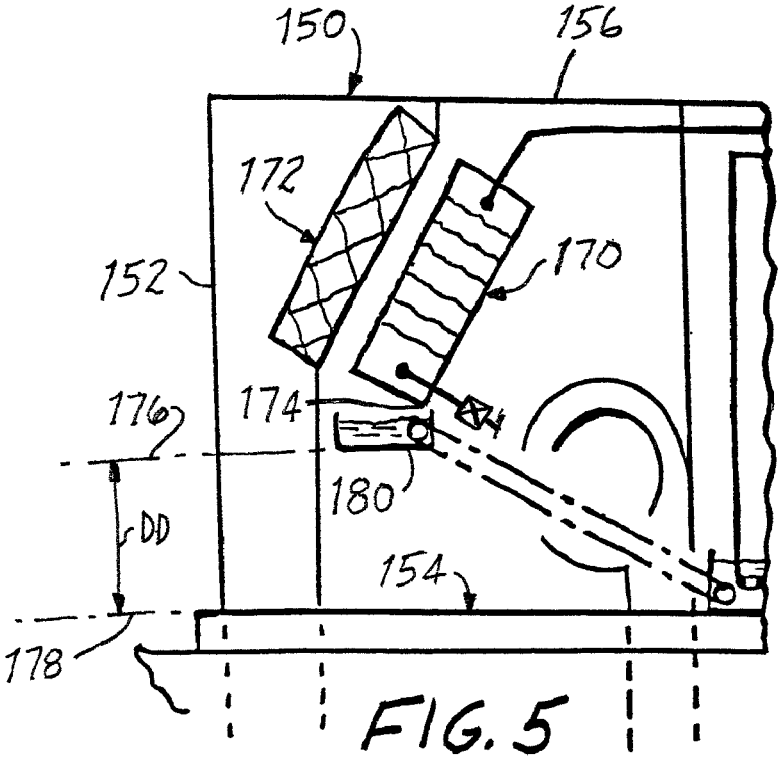
FIG. 5 is a fragmentary diagrammatic side elevational view similar to FIG. 2 and showing an alternate embodiment.

In some instances the evaporator of an existing self-contained air-conditioning unit may have a height so great as to occupy a substantial portion of the distance available within the housing of the unit, between the base and the top of the housing. Thus, as illustrated in FIG. 4 a self-contained air-conditioning unit 150 includes a housing 152 having a base 154 and a top 156. An evaporator 160 extends essentially from adjacent the base 154 to adjacent the top 156 of the housing 152, as does air filter 162. In this instance, the evaporator 160, as well as air filter 162, may be removed and replaced, as shown in FIG. 5, with an evaporator 170 and an air filter 172, each having a lesser height such that the lowermost edge 174 of the replacement evaporator 170 can be located adjacent an appropriate selected level 176, placed a vertical distance DD above basal surface 178 of the base 154 of the housing 152, and a condensate collection pan 180 is placed at the level 176. Replacement evaporator 170 is dimensioned and configured to provide sufficient evaporative capacity to serve as a substitute for evaporator 160. Likewise, replacement air filter 172 is dimensioned and configured to provide sufficient filtering capacity. Thus, the evaporator 170 and the air filter 172, while shorter than original evaporator 160 and air filter 162, respectively, are both deeper. In this manner, collection and transfer of condensate from evaporator 170 is accomplished as described in connection with the embodiment of FIGS. 2 and 3, with a concomitant conservation of energy attained as set forth above.

It will be seen that the present invention attains all of the objects and advantages summarized above, namely: Provides a method for modifying an existing self-contained air-conditioning unit to effect conservation of energy needed to operate the unit; enables a simplified and inexpensive modification of an installed self-contained air-conditioning unit so that condensate generated during operation of the unit, rather than merely being discarded, is utilized for attaining energy conservation; increases economy of operation of an existing installed self-contained air-conditioning unit; increases the efficiency of operation of a self-contained air-conditioning unit; increases the longevity of a self-contained air-conditioning unit to provide the unit with an extended service life.

It is to be understood that the above detailed description of preferred embodiments of the present invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A method for modifying a self-contained air-conditioning unit to effect conservation of energy during operation of the unit, the unit having a housing including an exterior and an interior within which refrigerant is circulated through a refrigerant circuit including a compressor, a condenser and an evaporator, the housing having a basal surface adjacent a basal level, and the evaporator having a lowermost edge and placed within the housing with the lowermost edge closely adjacent the basal surface of the housing, the method comprising:

elevating the lowermost edge of the evaporator to an elevated level spaced vertically above the basal level, and securing the evaporator in place within the housing with the lowermost edge at the elevated level;

placing a condensate collection pan in a position beneath the lowermost edge of the evaporator for collecting condensate emanating from the evaporator during operation of the unit, at a selected level spaced vertically above the basal level by a vertical distance from the basal level;

inserting a heat exchange conduit into the refrigerant circuit between the compressor and the condenser;

placing a condensate reservoir tray adjacent the basal level;

placing the heat exchange conduit within the condensate reservoir tray, in position to become immersed in condensate within the condensate reservoir tray;

providing a condensate passage between the condensate collection pan and the condensate reservoir tray for the transfer of condensate from the condensate collection pan to the condensate reservoir tray; and selecting the vertical distance between the selected level and the basal level to assure effective transfer of condensate from the condensate collection pan to the condensate reservoir tray by gravity such that the heat exchange conduit will be immersed in condensate from the evaporator for the transfer of heat from the heat exchange conduit to condensate in the condensate reservoir tray during operation of the air-conditioning unit.

2. The method of claim 1 wherein the vertical distance is selected to be about two to six inches.

3. The method of claim 1 wherein placing the condensate reservoir tray adjacent the basal level places the condensate reservoir tray on the basal surface.

4. The method of claim 1 including placing the condensate passage adjacent the exterior of the housing.

5. The method of claim 1 wherein the heat exchange conduit provides a serpentine path of extended length for the refrigerant within the refrigerant circuit, and placing the heat exchange conduit within the condensate reservoir tray places the extended length of the serpentine path in position to become immersed in condensate within the condensate reservoir tray.

6. An improvement for modifying a self-contained air-conditioning unit to effect conservation of energy during operation of the unit, the unit having a housing including an exterior and an interior within which refrigerant is circulated through a refrigerant circuit including a compressor, a condenser and an evaporator, the housing having a basal surface adjacent a basal level, and the evaporator having a lowermost edge and placed within the housing with the lowermost edge closely adjacent the basal surface of the housing, the improvement comprising:

the lowermost edge of the evaporator being elevated to an elevated level spaced vertically above the basal level, and the evaporator being secured in place within the housing with the lowermost edge at the elevated level;

a condensate collection pan placed in a position beneath the lowermost edge of the evaporator for collecting condensate emanating from the evaporator during operation of the unit, at a selected level spaced vertically above the basal level by a vertical distance from the basal level;

a heat exchange conduit inserted into the refrigerant circuit between the compressor and the condenser;

a condensate reservoir tray placed adjacent the basal level;

the heat exchange conduit being placed within the condensate reservoir tray, in position to become immersed in condensate within the condensate reservoir tray;

a condensate passage between the condensate collection pan and the condensate reservoir tray for the transfer of condensate from the condensate collection pan to the condensate reservoir tray; and the vertical distance between the selected level and the basal level being sufficient to assure effective transfer of condensate from the condensate collection pan to the condensate reservoir tray by gravity such that the heat exchange conduit will be immersed in condensate from the evaporator for the transfer of heat from the heat exchange conduit to condensate in the condensate reservoir tray during operation of the air-conditioning unit.

7. The improvement of claim 6 wherein the vertical distance between the selected level and the basal level is about two to six inches.

8. The improvement of claim 6 wherein the condensate reservoir tray is placed on the basal surface.

9. The improvement of claim 6 wherein the condensate passage is placed adjacent the exterior of the housing.

10. The improvement of claim 6 wherein the heat exchange conduit includes a serpentine path of extended length for the refrigerant within the refrigerant circuit, and the extended length of the serpentine path is placed in position to become immersed in condensate within the condensate reservoir tray.

11. A method for modifying an existing self-contained air-conditioning unit to effect conservation of energy during operation of the unit, the unit having a housing including an exterior and an interior within which refrigerant is circulated through a refrigerant circuit including a compressor, a condenser and an evaporator, the housing having a basal surface adjacent a basal level, and the evaporator having a lowermost edge and placed within the housing with the lowermost edge closely adjacent the basal surface of the housing, the method comprising:

replacing the evaporator with an alternate evaporator having a corresponding lowermost edge;

elevating the corresponding lowermost edge of the alternate evaporator to an elevated level spaced vertically above the basal level, and securing the alternate evaporator in place within the housing with the corresponding lowermost edge at the elevated level;

placing a condensate collection pan in a position beneath the corresponding lowermost edge of the alternate evaporator for collecting condensate emanating from the alternate evaporator during operation of the unit, at a selected level spaced vertically above the basal level by a vertical distance from the basal level;

inserting a heat exchange conduit into the refrigerant circuit between the compressor and the condenser;

placing a condensate reservoir tray adjacent the basal level;

placing the heat exchange conduit within the condensate reservoir tray, in position to become immersed in condensate within the condensate reservoir tray;

providing a condensate passage between the condensate collection pan and the condensate reservoir tray for the transfer of condensate from the condensate collection pan to the condensate reservoir tray; and selecting the vertical distance between the selected level and the basal level to assure effective transfer of condensate from the condensate collection pan to the condensate reservoir tray by gravity such that the heat exchange conduit will be immersed in condensate from the alternate evaporator for the transfer of heat from the heat exchange conduit to condensate in the condensate reservoir tray during operation of the air-conditioning unit.

12. The method of claim 11 wherein the vertical distance is selected to be about two to six inches.

13. The method of claim 11 wherein placing the condensate reservoir tray adjacent the basal level places the condensate reservoir tray on the basal surface.

14. The method of claim 11 including placing the condensate passage adjacent the exterior of the housing.

15. The method of claim 11 wherein the heat exchange conduit provides a serpentine path of extended length for the refrigerant within the refrigerant circuit, and placing the heat exchange conduit within the condensate reservoir tray places the extended length of the serpentine path in position to become immersed in condensate within the condensate reservoir tray.

* * * * *